United States Patent [19]

Larkin

[11] Patent Number: 4,944,396

[45] Date of Patent: Jul. 31, 1990

[54] CLUB REMOVAL INDICATOR

[76] Inventor: Mark Larkin, 419 Northgate, Lindenhurst, Ill. 60046

[21] Appl. No.: 325,950

[22] Filed: Mar. 20, 1989

[51] Int. Cl.[5] ..... A63B 55/04

[52] U.S. Cl. ..... 206/315.6; 206/315.7

[58] Field of Search ..... 206/315.2, 315.3, 315.6, 206/315.4, 315.7

[56] References Cited

U.S. PATENT DOCUMENTS 4,029,136 6/1977 Jacoby ..... 206/315.3
4,200,131 4/1980 Chitwood et al. ..... 206/315.6
4,227,559 10/1980 Stroman ..... 206/315.2
4,746,014 5/1988 Very ..... 206/315.6

*Primary Examiner*—Joseph Man-Fu Moy
*Attorney, Agent, or Firm*—Robert S. Beiser

[57] ABSTRACT

The present invention is a device for indicating when a golf club is removed from a golf bag, and from which location the club has been removed. A tubular indicator member is pulled by the golf club from the particular aperture where the club resides the tubular indicator extends upwardly so as to visually indicate the location and number of the club that was removed.

12 Claims, 5 Drawing Sheets

CLUB REMOVAL INDICATOR

BACKGROUND OF THE INVENTION

In the game of golf, clubs are usually carried in a bag. For organizing these clubs, of which there can be up to 14, many bags are provided with a multi-hole top portion, referred to as a "club saver". The "club saver" consists of a multiple hole structure, preferably plastic, with downwardly extending tubes to protect each club.

A problem many golfers have with "club savers" is to quickly find the hole from which a club was removed, because of the array of clubs surrounding the hole, and the dark color of which most "club savers" are molded. Thus a problem exists in locating the hole from which the club was removed, and indicating that a club, such as a putter, was left on the green, etc.

There has been a product introduced to help the golfer with these problems. This product consists of several light colored plugs on a key chain which can be installed in the holes when those clubs are removed. Even though this system is an adequate solution, it can be a time consuming ritual for the golfer, and the plugs are easily lost.

Accordingly, it is an object of the present invention to provide a low in cost club out indicator which is automatic, easy to use, and cannot be easily lost or separated from the golf bag.

These and other objects of the invention are accomplished by the present invention.

SUMMARY OF THE INVENTION

The present invention is an automatic device for indicating when a golf club is removed from a bag, and from which location the club has been removed. The indicator consists of a tube having top and bottom flanges which function as limits on upward down-ward motion, a tubular center portion which fits closely inside the hole of the "club saver", and flexible fingers in the distal end of the tube which, when engaged by the club grip, cause the indicator to move up or down until the appropriate "stop" is engaged. Protrusions on the sidewalls impart frictional forces against the inside of the cylindrical "club saver" hole to hold the indicator in the upwardly extended or "club out" position.

The indicator is preferably molded in a flexible, light colored thermoplastic (PVC, Kraton ®, etc.) or rubber. They are snapped into the "club saver" holes and become captive until deliberately removed. The indicators can be color coded, and/or be identified by club number, etc.

DETAILED DESCRIPTION OF THE DRAWINGS

DETAILED DESCRIPTION OF THE PREFERRED EMBODIMENTS

Figure 1:
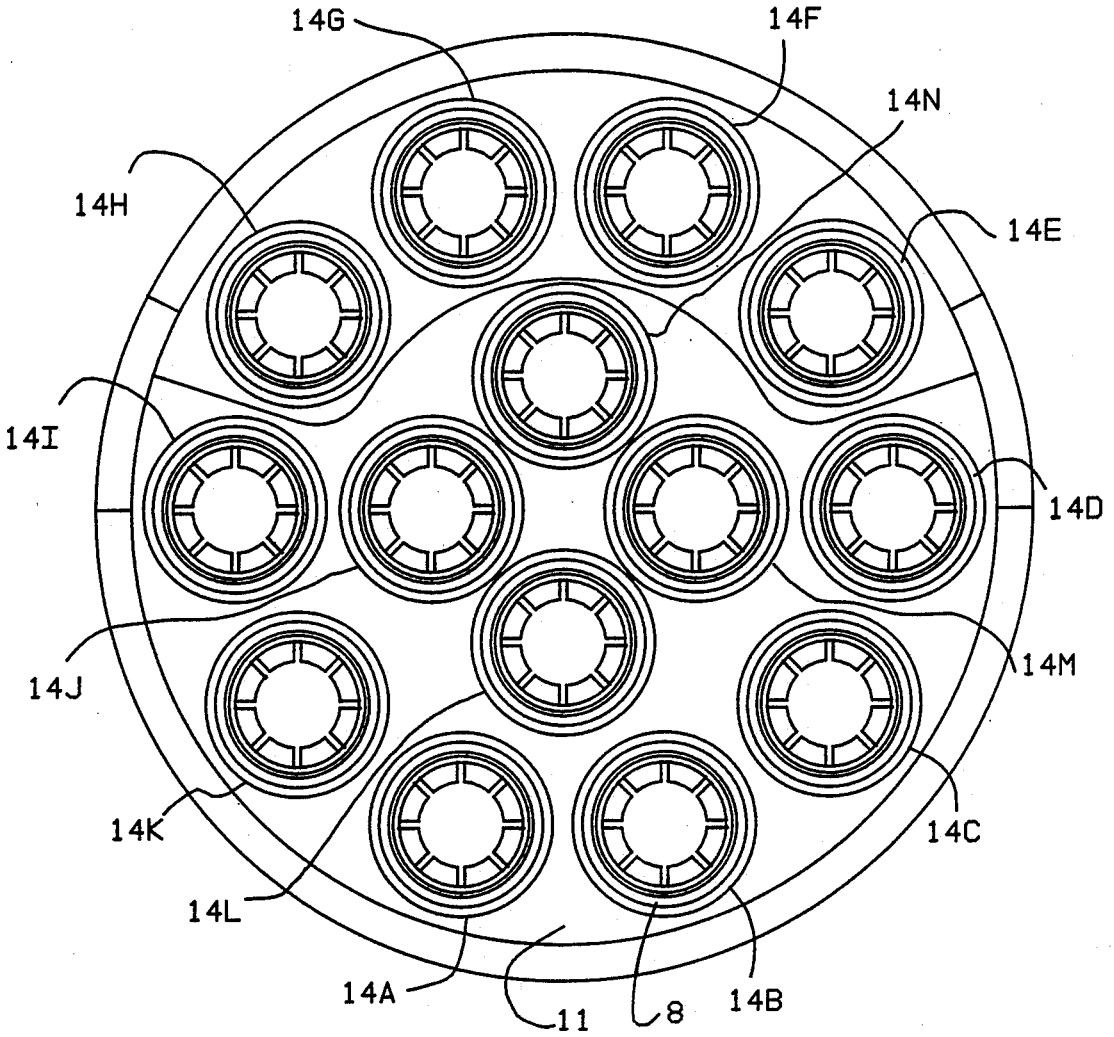
FIG. 1, is a top plan view of a device for indicating removal of golf clubs from a golf bag.
Figure 2:
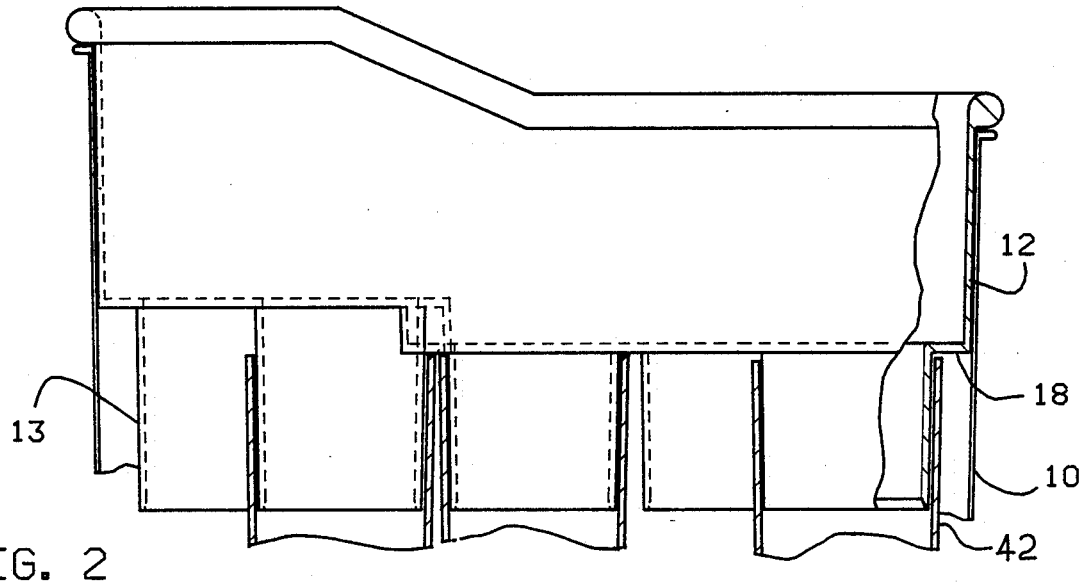
FIG. 2, is a side view, partially broken away of the club indicator device of FIG. 1.
Figure 6:
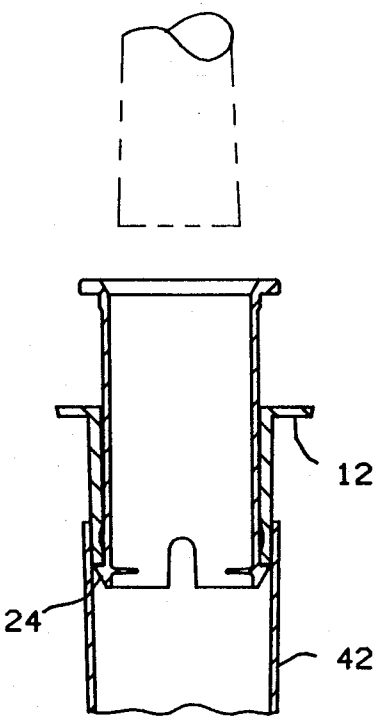
FIG. 6, is a vertical section of the tubular indicator of FIG. 4 showing a golf club being removed from the tubular indicator so as to cause the tubular indicator to be drawn outwardly from the insert and be retained in an extended position.
Figure 5:
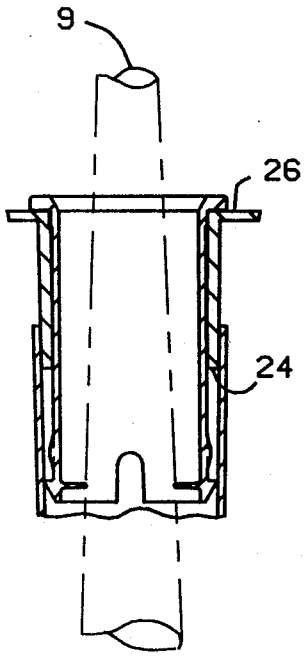
FIG. 5, is a vertical section of the tubular indicator of FIG. 4 showing a golf club grip, pushing downwardly in the tubular indicator, so as to force the tubular indicator into a recessed position in the insert member.
Figure 4:
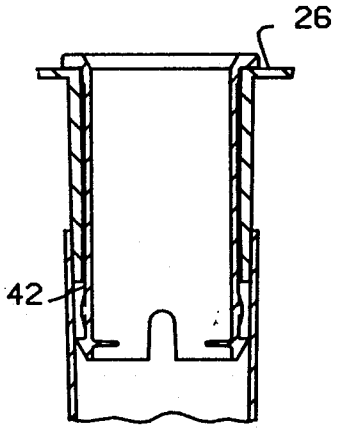
FIG. 4, is a vertical section of one of the tubular indicators of FIGS. 1 and 2 showing the tubular indicator in a recessed position.
Figure 3:
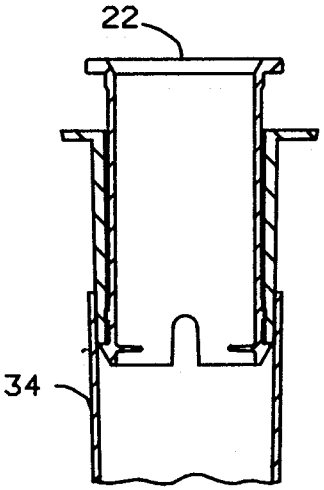
FIG. 3, is a vertical section of one tubular indicator used in the club out indicator of FIGS. 1 and 2, showing in particular the tubular indicator in a extended position.

As shown in FIGS. 1 and 2 of the drawings, a device 8 is provided for indicating the absence of golf clubs 9 (best shown in FIGS. 5 and 6). Each of the golf clubs has a shaft 9*a*, a head 9*b* and a grip 9*c*. Removal of the golf club 9 from the golf bag 8 is visually indicated by the device 8. In particular, the golf bag 10 has an open top 11. Within the open top 11 is a substantially planar club saver insert member 12. A plurality of apertures 14*a* through 14*n* extend through the club saver insert member 12. The apertures 14*a* through 14*n* are constructed and arranged; i.e., sized and positioned for reception and support of the individual golf clubs 9, and for separation of the head portions 9*b* of the golf clubs 9 from each other.

An attachment mechanism in the form of a shoulder 18 is provided for attaching and supporting the club saver insert member 12 in the opening 11 of the golf bag 10. The club saver insert member 12 is preferably disposed in a parallel position to the opening which is supported on the rim 20 of the golf bag.

As seen in FIGS. 2 through 10, a plurality of tubular indicator members 22 are provided. Each of the indicator members has an outside diameter 22*a* substantially equal to the inside diameter 14*aa* of apertures 14*a* through 14*n*. As a result, the tubular indicator members 22 may be slidably positioned in apertures such as aperture 14*a*. As best seen in FIG. 2, a stop mechanism 24 is provided by a top flange 26 and a bottom flange 28. As a result, tubular insert member 22 cannot be inserted entirely into aperture 14 nor can it be entirely removed.

As further seen in FIG. 2, one or more protrusions 30 are provided on the exterior surface of tubular insert member 22 for abutting against and frictionally engaging the inside surface 32 of aperture 14. The inside surface 32 of the aperture 14*a* butts against the protrusion 30 to retain the tubular insert member 22 in place.

As is further shown in FIG. 2, aperture tube 34 may extend downwardly from aperture 14. Corresponding apertures 34*b* through 34*o* tube may extend from each of the apertures 14*b* through 14*n*. The aperture tube 34 is constructed and arranged for interaction with the stop mechanism 24. Specifically, the bottom flange 28 of the stop mechanism 24 is adapted for abutment against the distal end 38 of the aperture tube 34, thereby preventing its removal from the aperture 14.

As further shown in FIG. 1, a plurality of flexible fingers 16, such as fingers 16*a* through 16*h* are shown. Flexible fingers 16 are adapted for flexible engagement with golf grip 9*c* when golf club 9 is inserted into aperture 14 or removed therefrom. The mechanical gripping of flexible fingers 16 on golf grip 9*c* causes the tubular indicator member 22 to be pulled upwardly when the golf club 9 is removed. However, when the bottom flange 28 abuts against either the distal end 38 of aperture tube 34 or the bottom surface 40 of club saver insert member 12. The protrusions 30 thereupon hold the tubular indicator member 22 in an extended position, so as to visually indicate by looking into the bag 10 that a particular club has been removed. Conversely, when golf club 9 is inserted back into the golf bag 10 and into one of the apertures 14, the tubular golf grip 9*c* abuts against and pushes on flexible fingers 16, thereby sliding tubular indicator 22 downwardly into aperture 14 and aperture tube 34 until top flange 24 abuts against the top surface 42 of the club saver insert member 12, which then stops further downward movement of the tubular indicator, but not the club 9.

As further shown in FIG. 6, in a preferred embodiment, aperture tube 34 further includes a club protector tube 42 which extends downwardly from each of the aperture tubes 34 into the bag 10. The club protector tube 42 is preferably constructed flexible plastic such as polyethylene having a thickness of 10 to 50 mm which protects the surface of the shaft 9*a* of the golf club 9.

As further shown in FIGS. 3 through 6, tubular indicator member 22 may have one or more slots 44 formed therein so as to provide increased flexibility of the side walls of the tubular indicator member, for facilitating insertion or removal of golf club 9. In addition, this flexibility allows the tubular indicator member to flex outwardly when the golf club 9 is inserted, thereby allowing enough room in the aperture 14 for the golf shaft 9*a*.

Figure 8:
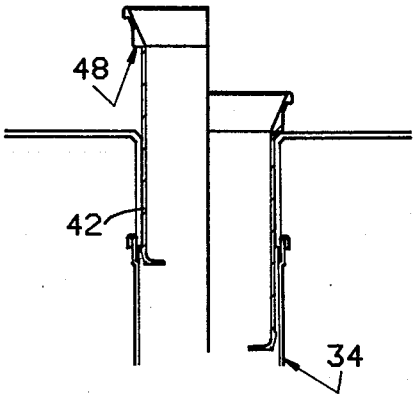
FIG. 8, is a vertical section of an additional alternate embodiment showing the tubular indicator member extending from an aperture having a downwardly depending aperture tube, and having an aperture tube extension attached to the end thereof.
Figure 7:
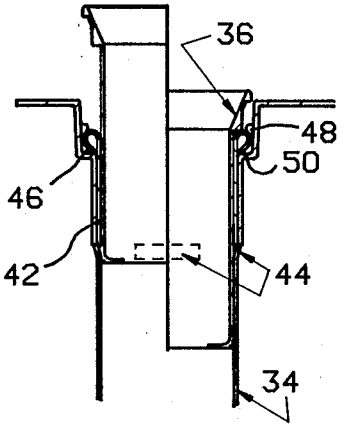
FIG. 7, is a vertical section of an alternate embodiment of a tubular indicator, showing in particular, a recessed aperture and an aperture tube having a rolled lip thereon supported in the recessed aperture.
Figure 10:
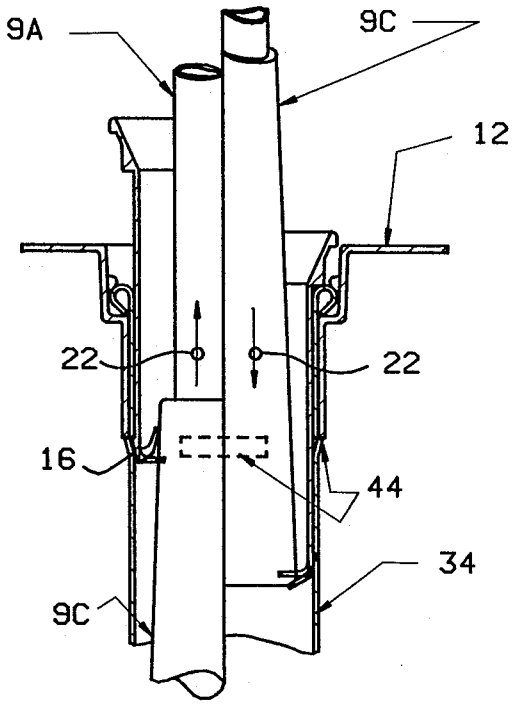
FIG. 10, is a vertical section showing a tubular indicator member having a rolled lip and a cap adapted for frictional engagement between the cap and the rolled lip so as to retain the cap thereon, thereby protecting the interior of the golf bag when the club is removed.

As shown in FIG. 7 of the drawings, in one embodiment of the invention, the club protector tube 42 has a rolled lip 46. In this embodiment, aperture 14 has a recess 48 formed therein, sized for reception and support of the rolled lip 46 on the ledge 50. This facilitates construction and or insertion and removal of the protector tube 42 without attachment to aperture tube 34. Conversely, as shown in FIG. 8, in one embodiment the club protector tube 42 may be heat sealed or glued to aperture tube 34 at its distal end 38.

Figure 9:
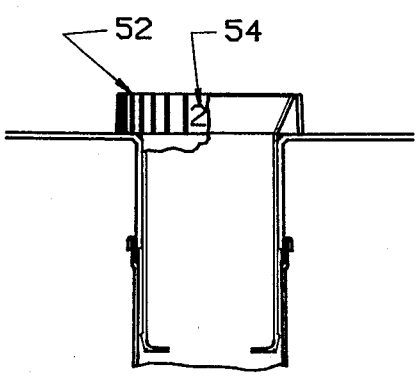
FIG. 9, is a vertical section of an additional alternate embodiment of the invention showing a tubular indicator member having a raised vertical flange with ribs formed thereon, and a club number embossed on the base of the vertical flange.
Figure 11:
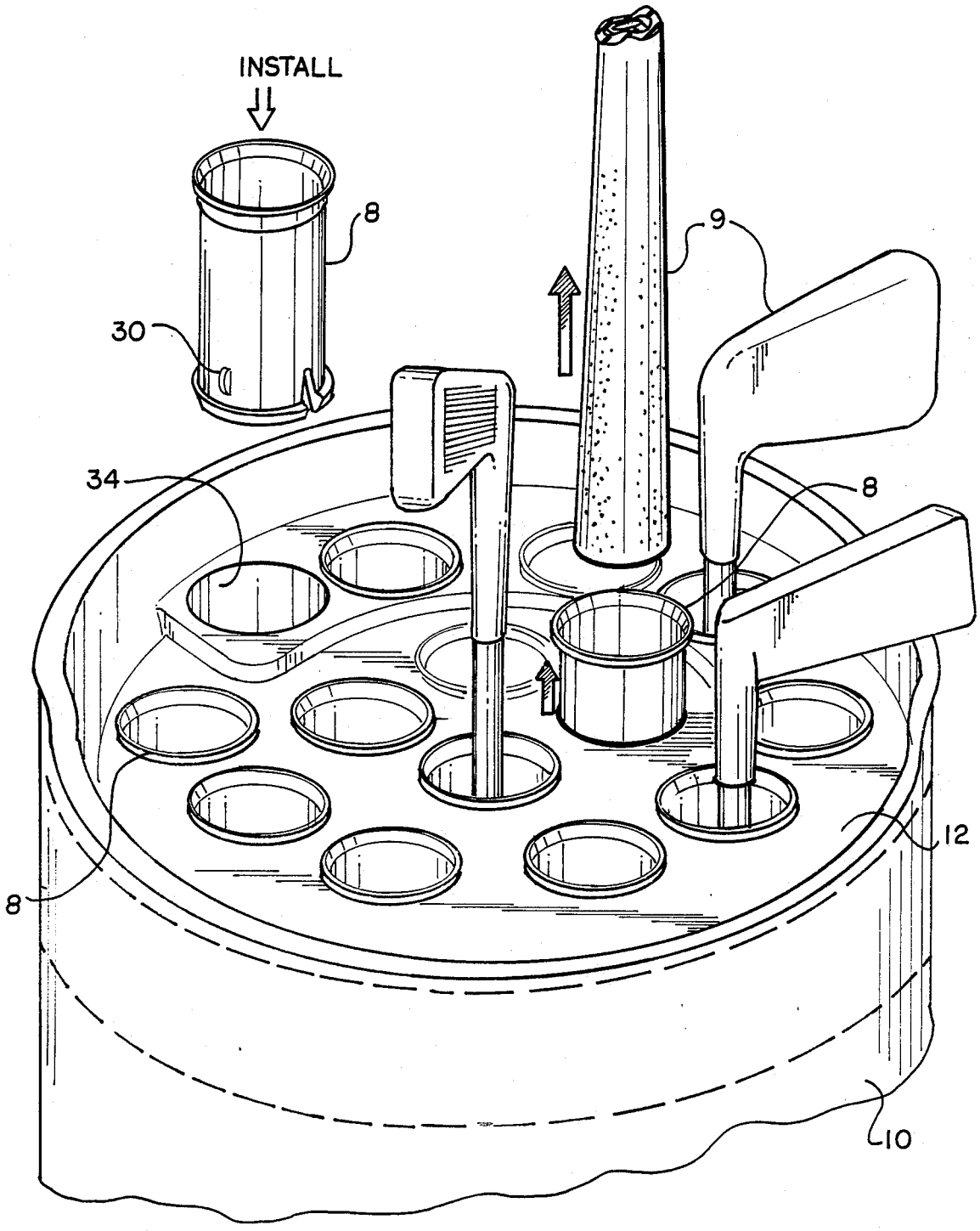
FIG. 11, is a prespective view of golf bag with club saver, showing indicators in holes.

As shown in FIG. 9 of the drawings, in one embodiment, the tubular indicator 9 has a raised vertical flange 52 with the number 54 of the golf club to be inserted in that particular aperture. This numeric indicia 54 allows easy identification of the club or clubs which have been removed from the golf bag 10. As further shown in FIGS. 10 and 11, in one embodiment, a cap 52 is provided for attachment to tubular indicator member 22. As a result, when golf club 9 is removed from the golf bag, the aperture may be covered, if desired.

The foregoing description and drawings merely explain and illustrate the invention, and the invention is not limited thereto except insofar as those who have the disclosure before them are able to make modifications and variations therein without departing from the scope of the invention.

I claim as my invention:

1. A device for indicating the absence of golf clubs, each of which has a shaft, a head and a grip, from a golf bag having an open top, said device comprising:

a substantially planar golf bag insert member having a plurality of apertures extending therethrough, each of said apertures being constructed and arranged for telescopic reception and support of an individual golf club and separation of said head portion of said golf club from the head portion of the other golf clubs when said golf clubs are positioned in said apertures;

attachment means for attaching and supporting said insert member in said golf bag in a parallel position to said open top of said golf bag;

a plurality of tubular indicator members, each of said indicator members having an outside diameter substantially equal to the inside diameter of said apertures, whereby each of said tubular indicators may be slidably positioned in an aperture;

stop means for retaining said tubular indicator members within said apertures of said insert member when said tubular members are slid upwardly or downwardly; and means associated with said tubular insert members for engaging said grip of said golf club when said golf club is inserted or removed from said golf bag, wherein said means associated with said tubular insert members for engaging said grip of said golf club comprises one or more fingers extending inwardly from said tubular indicator member proximate the bottom portion thereof, said flexible fingers being adapted to flexibly engage said grip of said golf club, whereby sliding movement of said golf club during removal of said golf club from said golf bag causes said tubular indicator member to be drawn outwardly and extend from said insert member, thereby visually indicating the absence of the golf club associated with said aperture, and wherein insertion of said golf club causes said tubular indicator member to be depressed back into said aperture of said insert member.

2. The device of claim 1 and further comprising a plurality of aperture tubes extending downwardly from said apertures, said aperture tubes being constructed and arranged for telescopic reception of said golf clubs and for abutment against and interaction with said stop means so as to prevent the removal of said tubular indicator members from said apertures.

3. The device of claim 1, wherein said attachment means comprises a shoulder portion having a diameter larger than the inside diameter of said golf bag whereby said insert member may be inserted into the opening of the golf bag and supported thereon.

4. The device of claim 1, wherein said tubular indicator members comprise one or more slots integrally formed therein so as to provide flexibility to the lower portion of said tubular indicator members thereby facilitating telescopic reception of and engagement with the grip of a golf club when the golf club is inserted into the tubular indicator member or removed therefrom.

5. The device of claim 1, wherein said stop means comprises a top flange disposed about the periphery of the top portion of the tubular indicator member and a bottom flange disposed about the periphery of the bottom of the tubular indicator member, said top and bottom flanges respectively being adapted to prevent removal of the tubular insert member when a golf club is removed from the golf bag and conversely said top flange member being adapted to retain the top portion of the tubular indicator member proximate the aperture in said insert member.

6. The device of claim 2, wherein each of said tubular indicator members include one or more protrusions extending therefrom said protrusions being adapted for abutment against and frictional engagement with the interior surface of the aperture tubes whereby said tubular indicator members may be frictionally engaged within the aperture tubes so as to maintain a fixed position therein either extended from or retracted into the insert member.

7. The device of claim 1, wherein said apertures include a recessed portion extending below the planar surface of the insert member, said recessed portion being adapted for reception of and abutment against the bottom portion of said tubular indicator member so as to prevent removal of said tubular indicator member.

8. The device of claim 2, wherein said aperture tube includes a rolled lip proximate the top portion thereof and said aperture includes a recessed portion adapted for support of said aperture tube on said rolled lip, with said aperture tube extending through said recessed portion.

9. The device of claim 1, wherein said tubular insert member further includes a plurality of club saver tubes extending downwardly from each of said apertures and supported on said club saver tubes being adapted to protect said golf clubs from impact against one another.

10. The device of claim 1, wherein said tubular indicator members each include numeric indicia of the club contained within the aperture.

11. The device of claim 1, wherein said tubular indicator members further include a removable cap member, said cap member including means for selective attachment to the top portion of said tubular indicator member.

12. A device for indicating the absence of a golf club from a golf bag comprising:

mechanical means for visually indicating the removal of said golf club from said golf bag, wherein said mechanical means comprises a golf bag insert member having a plurality of apertures extending therethrough, wherein each of said apertures is constructed and arranged for telescopic reception of a corresponding tubular indicator member; and wherein each of said tubular indicator members comprises one of more fingers extending inwardly therefrom to physically engage said golf club; and wherein said mechanical means is actuated by the removal of said golf club itself.

* * * * *